United States Patent [19]

McSwain

[11] 4,210,279

[45] Jul. 1, 1980

[54] TEMPERATURE-RESPONSIVE AUTOMATIC VENTILATOR

[76] Inventor: Edward D. McSwain, Rte. 7, Box 325, Lincolnton, N.C.

[21] Appl. No.: 16,491

[22] Filed: Mar. 1, 1979

[51] Int. Cl.[2] ..... F24F 7/00; F24F 13/14

[52] U.S. Cl. ..... 236/49; 236/101 D; 98/40 VT

[58] Field of Search ..... 236/49, 101 D; 98/40 VT; 73/363.7; 251/337

[56] References Cited

U.S. PATENT DOCUMENTS

| | | | |
|---|---|---|---|
| 2,187,767 | 1/1940 | Akers | 236/49 |
| 2,447,382 | 8/1948 | Whittier | 73/363.7 |
| 3,068,776 | 12/1962 | Day | 236/49 X |
| 3,378,199 | 4/1968 | Snell | 236/49 |
| 3,436,016 | 4/1969 | Edwards | 236/49 |
| 3,528,606 | 9/1970 | Witten | 236/49 X |
| 4,152,377 | 5/1979 | Takata | 236/101 C X |

*Primary Examiner*—Lloyd L. King
*Assistant Examiner*—William E. Tapolcai, Jr.
*Attorney, Agent, or Firm*—Wellington M. Manning, Jr.; Luke J. Wilburn, Jr.

[57] ABSTRACT

An automatic temperature responsive ventilator including a housing having side walls defining an air passageway and an openwork grid across the passageway. At least one shutter is mounted within the housing, with one end of one shutter element being associated with a bimetallic spring that is received within an opening in one housing side wall. A cap is received over the spring from the outside to hold the spring in place and protect the spring from the elements and from damage during installation. An outer end of the spring is held by a slot in the side wall and an inner end of the spring is secured to a rod that is attached to the shutter. Variations in ambient temperature cause the shutter element to open and close automatically.

11 Claims, 6 Drawing Figures

TEMPERATURE-RESPONSIVE AUTOMATIC VENTILATOR

BACKGROUND OF THE INVENTION

The present invention relates to a ventilator structure of the type that is normally disposed in the foundation of a dwelling or other type building structure. Ventilators are normally spaced around the periphery of a building, dwelling structure, or the like so as to permit proper ventilation beneath the floor level. Such ventilators are normally provided with one or more louvers that are moveable between a closed position that generally cuts off air flow through the ventilator, desirable during the colder months, and an open position that permits good air flow from the outside underneath the structure, normally during the warmer months.

Generally speaking, such vents have included two types, namely manual vents where one or more shutters is received in an air passageway with manual means to open and close same; and automatic vents where one or more shutters is received in a passageway and connected by some means to a thermally responsive spring, such as a bimetallic spring whereby the shutters automatically open and close, depending upon the ambient temperature. The present invention is of the latter type and constitutes an improvement over those known to exist. Particularly, the vent of the present invention is economical to manufacture, easy to install, utilizes a thermally responsive coil spring that, though exposed to ambient temperature for reaction thereto, is protected from the elements and possible damage due to mounting, and is directly connected to the shutter mechanism via a mounting means for same.

SUMMARY OF THE INVENTION

It is an object of the present invention to provide an improved, automatic ventilator assembly suitable for mounting in the foundation of a dwelling structure or the like so as to control the ingress of air beneath the floor level of same.

Another object of the present invention is to provide an improved automatic ventilator structure that utilizes a bimetallic spring for automatic opening and closing of shutter elements in the vent structure.

Yet another object of the present invention is to provide an improved ventilator assembly where the housing for same is molded of a synthetic, polymeric material and is unitary in structure and wherein a bimetallic spring operable to automatically open and close shutter elements of said ventilator is received within one of the side walls of the housing so as to be exposed to ambient temperature while being protected from the elements.

Still further, another object of the present invention is to provide an improved automatic ventilator assembly that may be conveniently installed in existing openings in foundation walls without the need for mortar.

Generally speaking, the present invention relates to an automatic ventilator structure comprising a housing, said housing having peripheral side walls defining an air passageway therethrough; at least one shutter element received in said air passageway and mounted to said housing for rotary movement between a closed position where the passageway is generally closed and an open position where the passageway is generally open to the passage of ventilating air therethrough; temperature-responsive spring means received in one of said side walls of said housing and secured against rotation therein; and rod means connected directly between said spring means and said shutter element whereby temperature variation effects on said such spring means cause said shutter element to move toward an open or closed position.

More specifically, the automatic ventilator of the present invention preferably includes a molded plastic housing that is unitary in structure insofar as side walls, protruding connector elements, and grid structure are concerned. Behind the grid structure and within the side walls are mounted a plurality of shutter elements that are interconnected for simultaneous movement. The side walls define an air passageway therebetween through which ventilating air may pass or be excluded, depending upon the attitude of the shutter elements. One of the side walls further defines an opening, generally circular in nature, with a peripherally protruding slot in which a coil bimetallic or thermally responsive spring is received with an outer end of the spring being received in the slot to secure against rotation of the spring in general upon experiencing temperature variations. An opposite end of the spring is received in a slotted rod, an opposite end of which is secured to one of the shutter elements whereby temperature variations significant to produce an expansion or contraction effect on the coil spring cause the rod to rotate in the appropriate direction and to drive the shutter toward an open or closed position.

The bimetallic spring is received within the side wall opening and preferably has a retainer-protector cap secured thereover. An outer end of the cap is received in an appropriate recess surrounding the opening whereby a continuous outer surface of the side wall exists when the cap is in place. Depending from the outer surface of the cap are a plurality of prongs having shoulder elements at an opposite free end thereof. Certain of the shoulder elements are presented outwardly to engage an inner surface of the side wall while certain of the shoulder elements are presented inwardly to engage a portion of the spring. The spring is thus secured in place within the side wall.

Protruding connector elements from the housing are provided to optionally receive a collar which may be secured thereto. The collar generally includes side walls defining an opening therewithin that corresponds in general to the size of the passageway of the vent housing and further has an outwardly extending peripheral flange around the side walls. A vent with a collar attached may be suitably employed in an opening, a foundation, or the like, with the protruding peripheral flange of the collar contacting an outer surface of the structure wall and covering any space between the vent housing and the wall per se.

DESCRIPTION OF THE PREFERRED EMBODIMENTS

Figure 1:
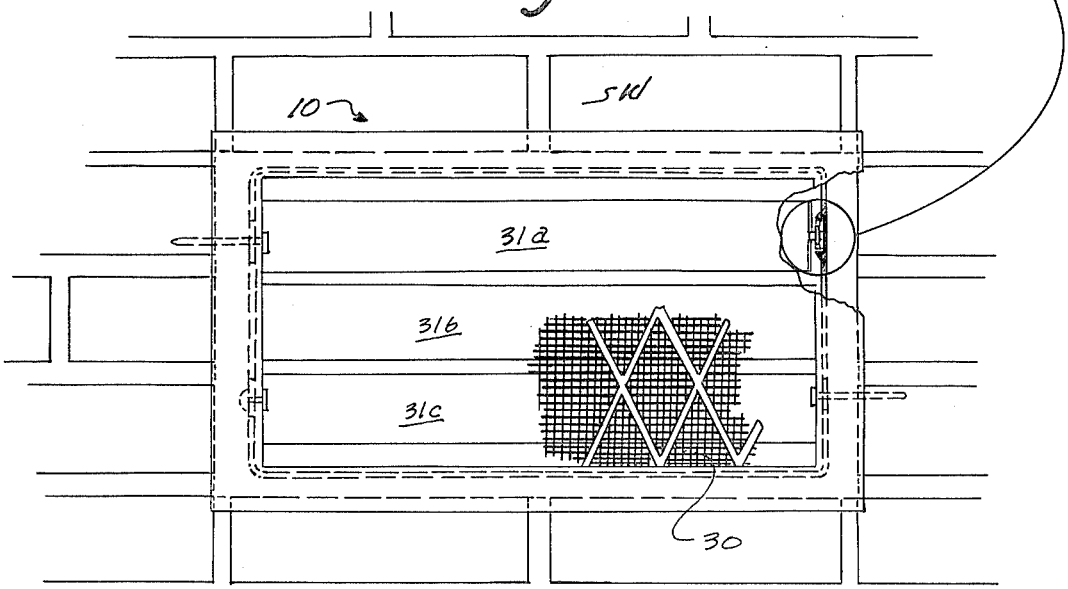
FIG. 1 is a front elevational view of a vent structure according to the present invention shown in its intended environment and illustrated partially in a cross section.
Figure 3:
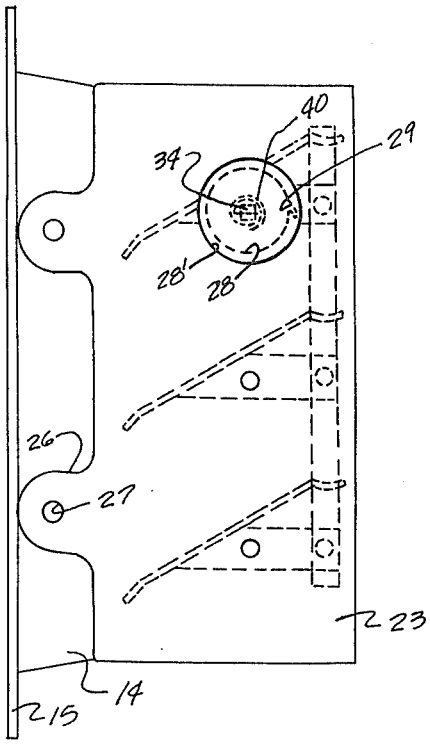
FIG. 3 is a side elevational view of a ventilator structure according to the teachings of the present invention.
Figure 6:
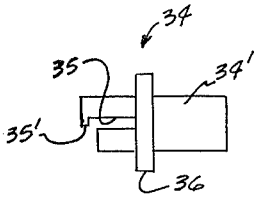
FIG. 6 is a side view of a mounting rod according to teachings of the present invention.
Figure 4:
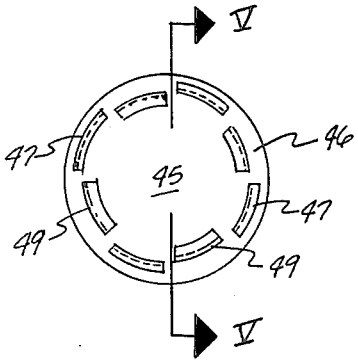
FIG. 4 is a plan view of the retainer-protective cap for the bimetallic spring for a vent structure according to teachings of the present invention.
Figure 5:
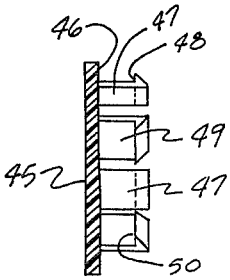
FIG. 5 is a cross sectional view of the cap as shown in FIG. 4 taken along a line V—V.

Referring to the figures, preferred embodiments of the present invention will now be described in detail. FIG. 1, for example, illustrates a ventilator according to teachings of the present invention in a preferred environment for use of same, that is a foundation wall W of a dwelling structure or the like where the ventilator provides means for ingress of ventilating air beneath the floor with the capability of controlling the amount of air depending upon ambient temperature. The vent generally indicated as 10 is thus shown mounted in the wall W. Under normal construction of the wall W from brick as shown, a rectangular shaped opening would be provided in the wall wherein the ventilator may be received and appropriately secured.

Figure 2:
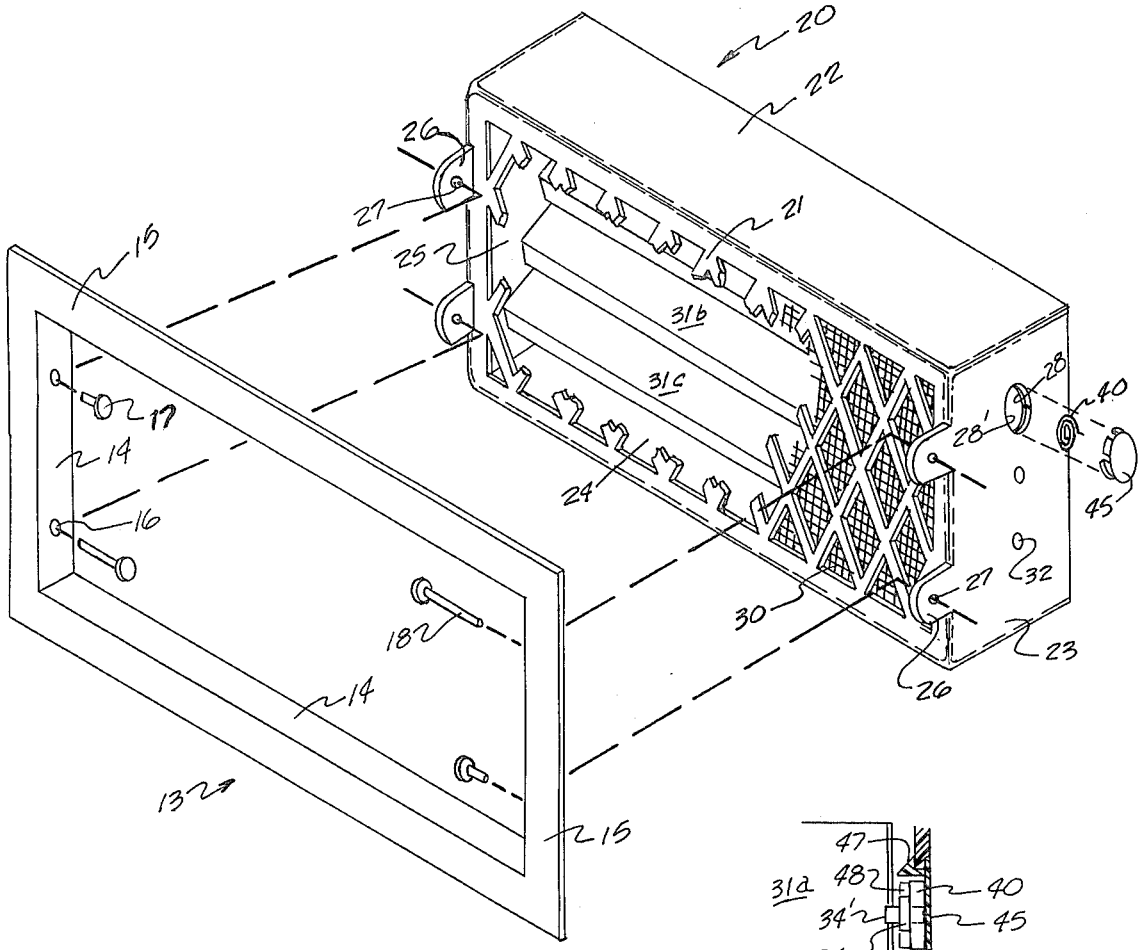
FIG. 2 is an isometric view of a vent structure according to the present invention with a portion of same exploded for clarity.
Figure 2:
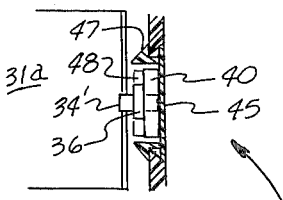

As to the particular details of the preferred ventilator construction, a housing generally indicated as 20 is provided, being represented by an openwork grid structure 21 which is preferably of unitary construction with side walls 22, 23, 24 and 25. Side walls 22, 23, 24 and 25 define an air passageway in which a plurality of shutter elements 31*a*, 31*b*, and 31*c* are received and mounted to side walls 23 and 25 by mounting elements 32 for limited rotary movement thereat between an opened and closed position, with the exception of one end of one of the shutter elements. As shown in FIG. 2, shutter element 31*a* has a special mounting at one end which will be described hereinafter. Housing 20 further has a plurality of protuberances 26 secured thereto having openings 27 therethrough. A collar generally indicated as 13 may also be provided which is made up of a plurality of side walls 14 having peripheral flanges 15 secured thereto and extending outwardly therefrom. Collar 13 is thus received adjacent protuberances 26 and has openings 16 in certain of the side walls thereof that correspond to the openings 27 in protuberances 26 of housing 20. In this fashion, collar 13 may be totally secured to protuberances 26 or certain of the matching openings may receive a securement pin 17 while certain receive an elongated element 18 that not only secures the collar to the housing, but extends into the side of wall W so as to secure the ventilator in place (See FIG. 1). In this fashion, utilizing collar 13 a ventilator 10 according to the present invention may be installed without the need for mortar, and moreover will fit various size openings in a foundation wall, where the difference between the size of the opening and the ventilator housing will be covered by the peripheral flange 15 of collar 13.

Housing 20 may further be provided with a screen 30 that is located behind grid 21 and secured in place. Screen 30 precludes the passage of insects through the air passageway of the ventilator structure. Referring particularly to FIGS. 2 through 6, one of the side walls, 23 as illustrated, further defines a generally cylindrical opening 28 having a peripheral slot 29 extending outwardly therefrom and being generally surrounded by a contersunk recess 28'. A thermally responsive coil spring 40 is receivable in opening 28 with an outer end of same extending into slot 29 to secure spring 40 against rotation. Only a portion of spring 40 is illustrated in phantom in FIG. 3 for the sake of clarity. An inner end of spring 40 is secured to a mounting rod 34 for shutter element 31*a*. Rod 34 is secured at one end 34' to shutter element 31*a* and has a slotted opposite end 35 in which the inner end of spring 40 is received and held by lip 35'. End 34' of rod 34 is preferably non-circular in shape, and most preferably is rectangular. A like shaped hole in shutter element 31*a* receives end 34' whereby relative rotation between the two is precluded. Rod 34 further has a collar element 36 intermediate its length to properly position same with respect to spring 40 and the interior of housing side wall 23. Spring 40 is thus received within side wall 23 of housing 20 and is held thereby by a cap 45 that is securably received in opening 28. Cap 45 has an interior shoulder 46 with a plurality of prongs 47 and 49 around same, located in a generally circular pattern. Prongs 47 and 49 have shoulder sections 48 and 50 respectively at outer free ends of same. Shoulder sections 48 and 50 extend in opposite directions whereby shoulder sections 48 may reside against the interior surface 23' of side wall 23 while shoulder sections 50 engage the side of coil spring 40. Cap shoulder 46 resides in countersink 28' of opening 28 while shoulders 48 and 50, as mentioned above, extend inwardly and reside against the inner surface 23' of side wall 23 or coil spring 40 respectively so as to maintain coil 40 in place and protect same against the elements or damage during installation. Since cap 45 resides in countersink 28', a continuous smooth outer surface is provided along side wall 23.

Shutter elements 31*a*, 31*b* and 31*c* are preferably interconnected by an elongated strip 33 that extends therebetween within housing 20 and is secured to each shutter by studs 33' for pivotal movement. In this fashion, as spring 40 is affected by ambient temperature to contract or expand, drive rod 34 turns in the responsive direction and causes shutter element 31*a* to rotate towards a closed or an open position, depending upon the particular temperature. In like fashion, since connector strip 33 is secured between all of the shutter elements, all of the elements simultaneously move in the direction of an open or closed position.

In a preferred situation, the housing and collar of the ventilator of the present invention are each of unitary construction, having been molded from a thermoplastic, polymeric material.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. An automatic ventilator comprising:

(a) a housing, said housing having peripheral side walls defining an air passageway therethrough, one of said side walls defining a spring receiving opening therein, said spring receiving opening being generally circular and defining a peripheral slot extending radially therefrom;

(b) at least one shutter element received in said air passageway and mounted to said housing for rotary movement between a closed position where the passageway is generally closed and an open position where the passageway is generally open to the passage of ventilating air therethrough;

(c) temperature responsive spring means received in said spring receiving opening, an outer end of said spring means being received in said slot to preclude rotation of said spring means;

(d) rod means connected directly between said spring means and said shutter element whereby temperature variation effects on said spring means cause said shutter element to move toward an open or closed position; and (e) cap means receivable in said side wall opening, said cap means having a plurality of members extending outwardly therefrom, said members having a shoulder at an outer end, certain of said shoulders being on opposite sides of said members from other of said shoulder, certain of said shoulders engaging an inside surface of said side wall and certain of said shoulders engaging a side of said spring, whereby said cap when inserted into said side wall opening secures said spring means within said side wall.

2. An automatic ventilator as defined in claim 1 wherein the housing is a plastic molded unit of unitary construction.

3. An automatic ventilator as defined in claim 2 wherein said housing further comprises an openwork grid structure across said air passageway.

4. An automatic ventilator as defined in claim 1 wherein a plurality of interconnected shutter elements are provided, one of said shutter elements only being directly connected to said spring means.

5. An automatic ventilator as defined in claim 4 wherein said shutter elements are interconnected by an elongated element secured to an end of each shutter element.

6. An automatic ventilator comprising:

(a) a housing, said housing having peripheral side walls defining an air passageway therethrough, one of said side walls defining a spring receiving opening therein;

(b) temperature responsive spring means received in said opening of said side wall of said housing, one end of said spring being held by said side wall to secure said spring against rotation;

(c) a rod received around a free end of said spring means and extending inwardly into said air passageway;

(d) a plurality of shutter elements received in said air passageway and mounted to said housing for limited rotational movement, one end of one of said shutter elements being secured to said rod, said shutter elements being interconnected for simultaneous movement between a closed position where said passageway is generally closed to an open position where said passageway is generally open; and (e) retainer means received around said spring means, said retainer means comprising a solid outer portion engageable with a portion of said side wall defining said opening, said outer portion having a plurality of prongs depending therefrom, said prongs having shoulder elements at an outer free end of same, certain of said shoulder elements being engageable with said spring and certain of said shoulder elements being engageable with an opposite surface of said side wall.

7. An automatic ventilator as defined in claim 1 wherein said spring means is a coil spring and where said side wall of said housing defining said opening further defines a peripheral slot in communication with said opening, said one end of said spring being received in said slot.

8. An automatic ventilator as defined in claim 1 wherein said housing further comprises an openwork grid structure secured to said side walls and extending across said passageway.

9. An automatic ventilator as defined in claim 1 wherein said housing is of unitary structure and is molded of a synthetic polymeric material.

10. An automatic ventilator as defined in claim 1 further comprising a collar element secureable to said housing around one end thereof, said collar element having a peripheral flange therearound extending outwardly from said housing.

11. An automatic ventilator as defined in claim 10 wherein said housing has a plurality of ears secured thereto and extending outwardly therefrom, said collar being secured to at least certain of said ears.

* * * * *